US009966026B2

(12) United States Patent
Zhao

(10) Patent No.: US 9,966,026 B2
(45) Date of Patent: May 8, 2018

(54) GATE DRIVER ON ARRAY SUBSTRATE AND LIQUID CRYSTAL DISPLAY ADOPTING THE SAME

(71) Applicant: Wuhan China Star Optoelectronics Technology Co., Ltd., Wuhan (CN)

(72) Inventor: Mang Zhao, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 135 days.

(21) Appl. No.: 14/905,966

(22) PCT Filed: Dec. 23, 2015

(86) PCT No.: PCT/CN2015/098421
§ 371 (c)(1),
(2) Date: Jan. 19, 2016

(87) PCT Pub. No.: WO2017/084145
PCT Pub. Date: May 26, 2017

(65) Prior Publication Data

US 2017/0140723 A1 May 18, 2017

(30) Foreign Application Priority Data

Nov. 18, 2015 (CN) ..... 2015 1 0798987

(51) Int. Cl.
*G09G 3/36* (2006.01)

(52) U.S. Cl.
CPC ... *G09G 3/3648* (2013.01); *G09G 2300/0439* (2013.01); *G09G 2310/08* (2013.01)

(58) Field of Classification Search
None
See application file for complete search history.

(56) References Cited

U.S. PATENT DOCUMENTS

2012/0139886 A1* 6/2012 Lee ..... G09G 3/3677 345/209
2015/0002377 A1* 1/2015 Liu ..... G09G 3/3258 345/77
2016/0328076 A1* 11/2016 Pan ..... G06F 3/0416
2017/0039973 A1* 2/2017 Huang ..... G09G 3/36

* cited by examiner

*Primary Examiner* — Amr Awad
*Assistant Examiner* — Andre Matthews

(57) ABSTRACT

A GOA substrate includes GOA circuit units connected in cascade. The GOA circuit unit includes an output module, a reset module, a latch module, and an input module. The output module is used for outputting the scan signal based on a trigger signal. The reset module is used for resetting the trigger signal based on the reset signal. The latch module is used to hold and pull down the electric potential of the trigger signal. The input module is used for receiving the scan signal outputted by the previous stage GOA circuit unit. The input module includes a first CMOS transmission gate and a first transistor. The input module can lower the equivalent on-resistance of the transistor, elevate the drive current between the input terminal and the output terminal, so to increase level transmission speed, lower drive power loss of the transistor and improve the stability of the circuit.

13 Claims, 4 Drawing Sheets

GATE DRIVER ON ARRAY SUBSTRATE AND LIQUID CRYSTAL DISPLAY ADOPTING THE SAME

RELATED APPLICATIONS

This application is a National Phase of PCT Patent Application No. PCT/CN2015/098421 having International filing date of Dec. 23, 2015, which claims the benefit of priority of Chinese Patent Application No. 201510798987.0 filed on Nov. 18, 2015. The contents of the above applications are all incorporated by reference as if fully set forth herein in their entirety.

FIELD AND BACKGROUND OF THE INVENTION

The present invention relates to liquid crystal display (LCD), and more specifically, to a liquid crystal display adopting a gate driver on array (GOA) substrate.

A gate driver is disposed on a glass substrate comprising a thin film transistor (TFT) in the process of a thin film transistor liquid crystal display (TFT-LCD) array for performing row-by-row scanning.

A GOA circuit comprises a plurality of GOA circuit units. The output module of each GOA circuit unit outputs a scan signal when driven by a trigger signal of a trigger node. However, if the drive current applied to the trigger node is not strong enough, it would affect the quality of the scan signal outputted by the output module. Therefore, upgrading the drive current of the trigger node of each GOA circuit unit is the goal of manufacturers.

SUMMARY OF THE INVENTION

An object of the present invention is to provide a GOA substrate and LCD adopting the GOA substrate, so to solve the problem of conventional technology.

According to the present invention, a gate driver on array (GOA) substrate comprises a plurality of pixel units arranged in an array, a plurality of transistors, each electrically connected to one of the pixel units, and a plurality of GOA circuit units connected in cascade. The GOA circuit unit at each stage outputs a scan signal from an output terminal based on the scan signal outputted by the previous stage GOA circuit unit, a first clock signal and a reset signal. The GOA circuit unit at each stage comprises an output module, a reset module, a latch module, and an input module. The output module is used for outputting the scan signal based on a trigger signal of a trigger node. The reset module is used for resetting the trigger signal based on the reset signal. The latch module electrically connected between the output module and input module, is used to hold and pull down the electric potential of the trigger signal. The input module electrically connected to the latch module is used for receiving the scan signal outputted by the previous stage GOA circuit unit. The input module comprises a first complementary metal-oxide-semiconductor (CMOS) transmission gate and a first transistor. The CMOS transmission gate comprises a second transistor and a third transistor. The second transistor is a P-channel MOSFET (PMOS) transistor and the third transistor is an N-channel MOSFET (NMOS) transistor. The first transistor comprises a drain electrically connected to an output terminal of the first CMOS transmission gate, a gate electrically connected to a gate of the second transistor and a scan signal outputted by the previous stage GOA circuit unit, and a source electrically connected to a first constant voltage.

In one aspect of the present invention, the second transistor comprises a gate electrically connected to the scan signal outputted by the previous stage GOA circuit unit, a source electrically connected to the source of the third transistor, and a drain electrically connected to the drain of the third transistor; the gate of the third transistor electrically connected to the inverted scan signal outputted by the previous stage GOA circuit unit.

In another aspect of the present invention, the input module further comprises a first inverter, comprising an input terminal electrically connected to the gate of the second transistor, and an output terminal electrically connected to the gate of the third transistor.

In another aspect of the present invention, the output module comprises an NAND gate, a second inverter, a third inverter and a fourth inverter. The NAND gate comprises an input electrically connected to a second clock signal and the trigger signal. The second inverter comprises an input electrically connected to the output of the NAND gate. The third inverter comprises an input electrically connected to the output of the second inverter. The fourth inverter comprises an input electrically connected to the output of the third inverter to output the scan signal.

In another aspect of the present invention, the first clock signal and second clock signal are inverted signals to each other.

In another aspect of the present invention, the reset module comprises a fourth transistor and a fifth transistor. The fourth transistor comprises a drain electrically connected to the trigger node, a gate electrically connected to the reset signal, and a source electrically connected to the first constant voltage. The fifth transistor comprises a drain electrically connected to a second constant voltage, a gate electrically connected to the reset signal, and a source electrically connected to the latch module.

In still another aspect of the present invention, the latch module comprises a sixth transistor, a seventh transistor, an eighth transistor, a ninth transistor, a tenth transistor and a second CMOS transmission gate. The sixth transistor comprises a gate electrically connected to a first node, and a source electrically connected to the first constant voltage. The seventh transistor comprises a drain electrically connected to the trigger node, a gate electrically connected to a second node and a source electrically connected to the drain of the sixth transistor. The eighth transistor comprises a drain electrically connected to the drain of the fifth transistor, a gate electrically connected to a first node, and a source electrically connected to the trigger node. The ninth transistor comprises a drain electrically connected to the drain of the fifth transistor, a gate electrically connected to the second node, and a source electrically connected to the trigger node. The second CMOS transmission gate comprises an input electrically connected to the first clock signal, and an output electrically connected to the first node to generate voltage to the first node based on the trigger signal of the trigger node. The tenth transistor comprises a drain electrically connected to the second constant voltage, a gate electrically connected to the trigger node, and a source electrically connected to the first node.

In yet another aspect of the present invention, the second CMOS transmission gate comprises an eleventh transistor and a twelfth transistor. The latch circuit further comprises a fifth inverter which comprises an input electrically connected to the gate of the twelfth transistor, and an output electrically connected to the gate of the eleventh transistor.

According to the present invention, a liquid crystal display comprises a source driver for outputting data signal to a plurality of pixel units to show images, and a gate driver on array (GOA) substrate, as mentioned above, for outputting scan signal to turn on a plurality of transistors.

Comparing to conventional technology, an input module of a GOA circuit unit at each stage of the GOA substrate of the present invention comprises a first complementary metal-oxide-semiconductor (CMOS) transmission gate and a first transistor, comprising a drain electrically connected to the output terminal of the first CMOS transmission gate. The input module can lower the equivalent on-resistance of the transistor, elevate the drive current of the trigger node so to increase level transmission speed, lower drive power loss of the transistor and improve the stability of the circuit.

These and other features, aspects and advantages of the present disclosure will become understood with reference to the following description, appended claims and accompanying figures.

DESCRIPTION OF SPECIFIC EMBODIMENTS OF THE INVENTION

Figure 1:
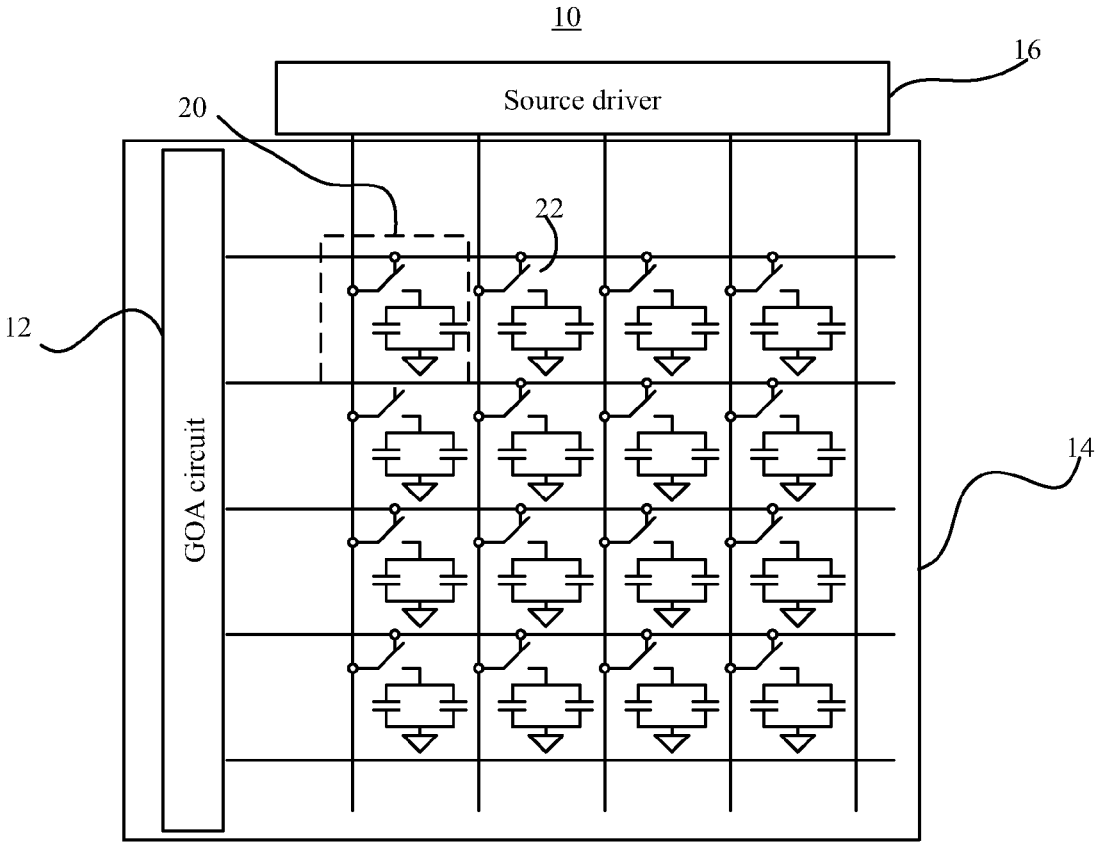
FIG. 1 is a functional block diagram of a LCD of the present invention.

Please refer to FIG. 1. FIG. 1 is a functional block diagram of a LCD 10 of the present invention. LCD 10 comprises a GOA substrate 14 and a source driver 16. The GOA substrate 14 comprises a plurality of pixels arranged in an array, and each pixel is composed of three pixel units 20 representing three primary colors—red, green and blue (RGB). In a 1024×768 resolution LCD display 10, a total of 1024×768×3 pixel units 20 is required. A GOA circuit 12 outputs a scan signal so that transistors 22 in each row are initiated one after another, while a source driver 16 outputs a corresponding data signal to a whole row of pixel units 20 so that each unit is charged to its required voltage respectively to display different gray scales. When one row completes charging, the GOA circuit 12 turns off the scan signal. Then, the GOA circuit 12 outputs a scan signal again to turn on transistors 22 in the next row, and the source drive 16 charges/discharges pixel units 20 in the next row. This process is repeated until all the pixel units 20 are charged, and then it starts from the first row again.

Existing LCD panels are designed as such that the GOA circuit 12 outputs scan signals based on a fixed interval. Take an LCD 10 with 1024×768 resolution and 60 Hz update frequency as an example: the display time for each frame is about 1/60=16.67 ms, so the pulse of each scan signal is 16.67 ms/768=21.7 μs. Within the 21.7 μs, the source driver 16 charges/discharges the pixel units 20 to the required voltages to display the corresponding gray scales.

Figure 2:
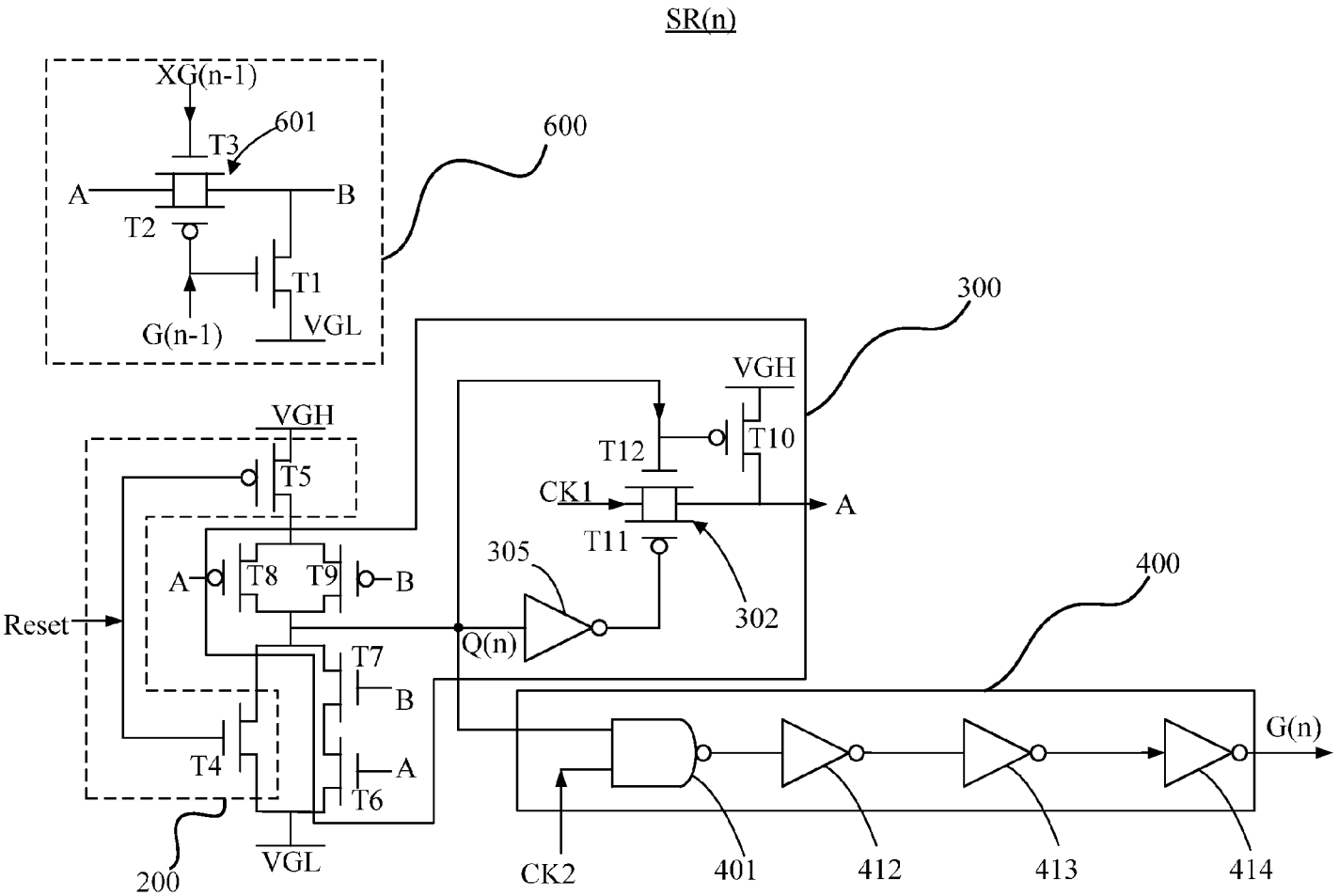
FIG. 2 is a circuit diagram of a GOA circuit unit of a GOA substrate of a first embodiment of the present invention.

Please refer to FIG. 2. FIG. 2 is a circuit diagram of a GOA circuit unit SR(n) of a GOA substrate 14 of a first embodiment of the present invention. A GOA circuit 12 comprises a plurality of cascade-connected GOA circuit units SR(n). Based on a scan signal outputted by a previous stage GOA circuit unit SR(n-1), a first clock signal CK1 and a reset signal Reset, the GOA circuit unit SR(n) at each stage outputs a scan signal G(n) from an output terminal. The GOA circuit unit SR(n) at each stage comprises an output module 400, a reset module 200, a latch module 300 and an input module 600.

The output module 400 outputs the scan signal G(n) according to a trigger signal of a trigger node Q(n). The reset module 200 resets the trigger signal according to the reset signal Reset. The latch module 300 electrically connects the output module 400 and reset module 200 to hold and pull down the electric potential of the trigger signal. The input module 600 electrically connects the latch module 300 to receive a scan signal G(n-1) outputted by the previous stage GOA circuit unit SR(n-1).

The input module 600 comprises a first CMOS transmission gate 601 and a first transistor T1. The first CMOS transmission gate 601 comprises a second transistor T2, a P-channel MOSFET (PMOS) transistor, and a third transistor T3, an N-channel MOSFET (NMOS) transistor. The first transistor T1 comprises a drain electrically connected to an output terminal B of the first CMOS transmission gate 601, a gate electrically connected to a gate of a second transistor T2 and the scan signal G(n-1) outputted by the previous stage GOA circuit unit SR(n-1), and a source electrically connected to a first constant voltage VGL. A gate of a third transistor T3 electrically connects a control signal XG(n-1), an inverted scan signal G(n-1) outputted by the previous stage GOA circuit unit SR(n-1). A source of the second transistor T2 electrically connects a source of the third transistor T3, and a drain of the second transistor T2 electrically connects a drain of the third transistor T3. The gates of the second transistor T2 and third transistor T3 electrically connects the scan signal G(n-1) outputted by the previous stage GOA circuit unit SR(n-1) and XG(n-1), the scan signal G(n-1) inverted, respectively. Preferably, the scan signal G(n-1) and the inverted signal XG(n-1) can come from, respectively, the output and input of a fourth inverter of the output module 400 of the previous stage GOA circuit unit SR(n-1).

The output module 400 comprises an NAND gate 401, a second inverter 412, a third inverter 413 and a fourth inverter 414. An input of NAND gate 401 electrically connects a second clock signal CK2 and a trigger signal of the trigger node Q(n). An input of the second inverter 412 electrically connects the output of the NAND gate 401. The input of the third inverter 413 electrically connects the output of the second inverter 412. The input of the fourth inverter 414 electrically connects the output of the third inverter 413 for outputting a scan signal G(n). The first clock signal CK1 and the second clock signal CK2 are inverted signals of each other.

The reset module 200 comprises a fourth transistor T4 and a fifth transistor T5. The fourth transistor T4 comprises a drain electrically connected to the trigger node Q(n), a gate electrically connected to the reset signal Reset, and a source electrically connected to the first constant voltage VGL. The fifth transistor T5 comprises a drain electrically connected to a second constant voltage VGH, a gate electrically connected to the reset signal Reset, and a source electrically connected to the latch module 300.

The latch module 300 comprises a sixth transistor T6, a seventh transistor T7, an eighth transistor T8, a ninth transistor T9, a tenth transistor T10, and a second CMOS transmission gate 302. The sixth transistor T6 comprises a gate electrically connected to an input terminal A, and a source electrically connected to the first constant voltage VGL. The seventh transistor T7 comprises a drain electrically connected to the trigger node Q(n), a gate electrically connected to an output terminal B, and a source electrically connected to the drain of the sixth transistor T6. The eighth transistor T8 comprises a drain electrically connected to the drain of the fifth transistor T5, a gate electrically connected to the input terminal A, and a source electrically connected to the trigger node Q(n). The ninth transistor T9 comprises a drain electrically connected to the drain of the fifth transistor T5, a gate electrically connected to the output terminal B, and a source electrically connected to the trigger node Q(n). The second CMOS transmission gate 302 comprises an input electrically connected to the first clock signal CK1, and an output electrically connected to the input terminal A, so to generate voltage to the input terminal A according to the trigger signal of the trigger node Q(n). The tenth transistor T10 comprises a drain electrically connected to the second constant voltage VGH, a gate electrically connected to the trigger node Q(n), and a source electrically connected to the input terminal A. The second CMOS transmission gate 302 comprises an eleventh transistor T11, a PMOS transistor, and a twelfth transistor T12, an NMOS transistor. The latch circuit 300 further comprises a fifth inverter 305, with its input electrically connected to a gate of the twelfth transistor T12, and its output electrically connected to the gate of the eleventh transistor T11.

Comparing to conventional technology, when the CMOS transmission gate 601 conduct signal, both the transistors T2 and T3 turn on to form two conducting paths between the input terminal A and the output terminal B. In contrast to using a single transistor, using the CMOS transmission gate 601 may reduce equivalent resistance. Therefore, the input module can lower the equivalent on-resistance of the transistor, elevate the drive current between the input terminal A and the output terminal B, so to increase level transmission speed, lower drive power loss of the transistor and improve the stability of the circuit.

Figure 3:
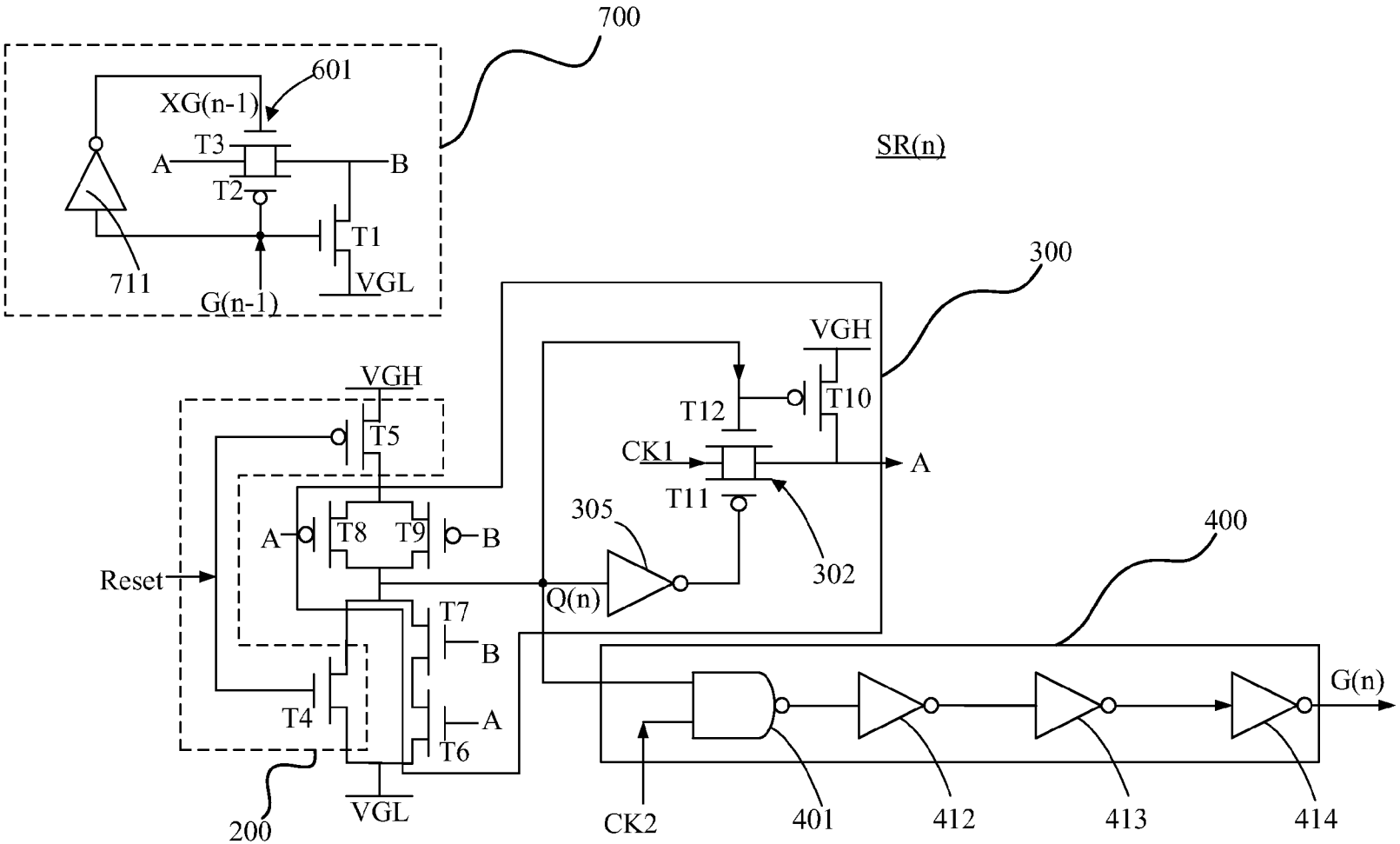
FIG. 3 is a circuit diagram of a GOA circuit unit of a GOA substrate of a second embodiment of the present invention.

Please refer to FIG. 3. FIG. 3 is a circuit diagram of the GOA circuit unit SR(n) of the GOA substrate 14 of a second embodiment of the present invention. Different from FIG. 2, FIG. 3 has an input module 700 further comprising a first inverter 711. The first inverter 711 comprises an input electrically connected to the gate of the second transistor T2, and an output electrically connected to the gate of the third transistor T3 of the first CMOS transmission gate 601. The first inverter 711 outputs the scan signals G(n-1) outputted by the previous stage GOA circuit unit SR(n-1) as an inverted signal XG(n-1). The embodiment shown in FIG. 2 directly adopts the output of the inverter 413 of the output module 400 of the previous stage GOA circuit unit SR(n-1) as the inverted signal XG(n-1). It increases the loading of the inverters 412, 413 and 414 and affects their driving ability. The embodiment shown in FIG. 3 makes use of the first inverter 711 of the input module 700 to output the scan signal G(n-1) as the inverted signal XG(n-1). The design of FIG. 3 can reduce the loading of the inverters 412, 413 and 414, and enhance their driving ability.

Figure 4:
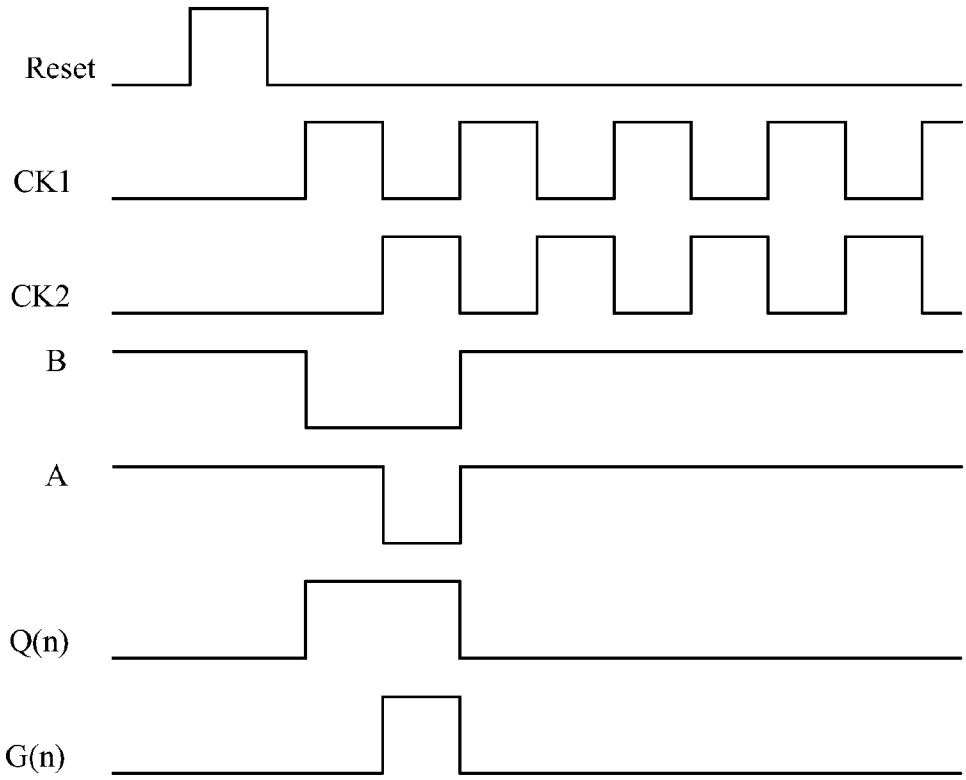
FIG. 4 is a timing chart of various input signals, output signals and node voltages shown in FIG. 3.

Please refer to FIG. 2, FIG. 3 and FIG. 4. FIG. 4 is a timing chart of various input signals, output signals and node voltages shown in FIG. 3. When the scan signal G(n-1) of the previous stage GOA circuit unit SR(n-1) is at a high level, the transistor T1 of the GOA circuit unit SR(n) will be turned on so that the level of the output terminal B will be reduced to a low level by the first constant voltage VGL. At the moment, the trigger node is at a high level and the input terminal A is of high impedance. When the scan signal G(n-1) of the previous stage GOA circuit unit SR(n-1) is switched to a low level, the second transistor T2 and third transistor T3 of the GOA circuit unit SR(n) will be turned on (i.e. the CMOS transmission gate 601 will be turned on), and the first transistor T1 will be turned off. At the moment, the trigger node Q(n) of the GOA circuit unit SR(n) is held at a high level, therefore the input terminal A and output terminal B are kept at a low level of the first clock signal CK1. When the second clock signal CK2 is switched to a high level, the output of the NAND gate 401 is at a low level. The output of the NAND gate 401 goes through the inverters 411, 412 and 413, and is outputted as an impulse of the scan signal G(n) of the GOA circuit unit SR(n). When the first clock signal CK1 is switched to a high level, the voltages of the input terminal A and output terminal B get to a high level, while the trigger node Q(n) of the GOA circuit unit SR(n) is held at a low level. At the moment, the scan signal G(n) of the GOA circuit unit SR(n) will be pulled down to a low level.

Comparing to conventional technology, when the CMOS transmission gate 601 conduct signal, both the transistors T2 and T3 turn on to form two conducting paths between the input terminal A and the output terminal B. In contrast to using a single transistor, using the CMOS transmission gate 601 may reduce equivalent resistance. Therefore, the input module can lower the equivalent on-resistance of the transistor, elevate the drive current between the input terminal A and the output terminal B, so to increase level transmission speed, lower drive power loss of the transistor and improve the stability of the circuit.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A gate driver on array (GOA) substrate, comprising:

a plurality of pixel units arranged in an array;

a plurality of transistors, each electrically connected to one of the pixel units; and a plurality of GOA circuit units, connected in cascade, with the GOA circuit unit at each stage outputs a scan signal from an output terminal based on the scan signal outputted by the previous stage GOA circuit unit, a first clock signal and a reset signal;

wherein the GOA circuit unit at each stage comprises:

an output module coupled to a trigger node, for outputting the scan signal based on a trigger signal applied on the trigger node;

a reset module, for resetting the trigger signal based on the reset signal;

a latch module, electrically connected between the output module and input module, to hold and pull down the electric potential of the trigger signal; and an input module, electrically connected to the latch module for receiving the scan signal outputted by the previous stage GOA circuit unit, comprising:

a first complementary metal-oxide-semiconductor (CMOS) transmission gate, comprising a second transistor and a third transistor, with the second transistor being a P-channel MOSFET (PMOS) transistor and the third transistor being an N-channel MOSFET (NMOS) transistor; and a first transistor, comprising a drain electrically connected to an output terminal of the first CMOS transmission gate, a gate electrically connected to a gate of the second transistor and a scan signal outputted by the previous stage GOA circuit unit, and a source electrically connected to a first constant voltage, wherein the reset module comprises:

a fourth transistor, comprising a drain electrically connected to the trigger node, a gate electrically connected to the reset signal, and a source electrically connected to the first constant voltage; and a fifth transistor, comprising a drain electrically connected to a second constant voltage, a gate electrically connected to the reset signal, and a source electrically connected to the latch module.

2. The GOA substrate of claim 1, wherein the second transistor comprises a gate electrically connected to the scan signal outputted by the previous stage GOA circuit unit, a source electrically connected to the source of the third transistor, and a drain electrically connected to the drain of the third transistor; the gate of the third transistor electrically connected to the inverted scan signal outputted by the previous stage GOA circuit unit.

3. The GOA substrate of claim 2, wherein the input module further comprises a first inverter, comprising an input terminal electrically connected to the gate of the second transistor, and an output terminal electrically connected to the gate of the third transistor.

4. The GOA substrate of claim 1, wherein the output module comprises:

an NAND gate, comprising an input electrically connected to a second clock signal and the trigger signal;

a second inverter, comprising an input electrically connected to the output of the NAND gate;

a third inverter, comprising an input electrically connected to the output of the second inverter; and a fourth inverter, comprising an input electrically connected to the output of the third inverter to output the scan signal.

5. The GOA substrate of claim 4, wherein the first clock signal and second clock signal are inverted signals to each other.

6. The GOA substrate of claim 1, wherein the latch module comprises:

a sixth transistor, comprising a gate electrically connected to a first node, and a source electrically connected to the first constant voltage;

a seventh transistor, comprising a drain electrically connected to the trigger node, a gate electrically connected to a second node and a source electrically connected to the drain of the sixth transistor;

an eighth transistor, comprising a drain electrically connected to the drain of the fifth transistor, a gate electrically connected to a first node, and a source electrically connected to the trigger node;

a ninth transistor, comprising a drain electrically connected to the drain of the fifth transistor, a gate electrically connected to the second node, and a source electrically connected to the trigger node;

a second CMOS transmission gate, comprising an input electrically connected to the first clock signal, and an output electrically connected to the first node to generate voltage to the first node based on the trigger signal of the trigger node; and a tenth transistor, comprising a drain electrically connected to the second constant voltage, a gate electrically connected to the trigger node, and a source electrically connected to the first node.

7. The GOA substrate of claim 6, wherein the second CMOS transmission gate comprises an eleventh transistor and a twelfth transistor; the latch circuit further comprises a fifth inverter, comprising an input electrically connected to the gate of the twelfth transistor, and an output electrically connected to the gate of the eleventh transistor.

8. A liquid crystal display, comprising:

a source driver, for outputting data signal to a plurality of pixel units to show images; and a gate driver on array (GOA) substrate, comprising:

a plurality of pixel units arranged in an array;

a plurality of transistors, each electrically connected to one of the pixel units; and a plurality of GOA circuit units, connected in cascade, with the GOA circuit unit at each stage outputs a scan signal from an output terminal based on the scan signal outputted by the previous stage GOA circuit unit, a first clock signal and a reset signal;

wherein the GOA circuit unit at each stage comprises:

an output module coupled to a trigger node, for outputting the scan signal based on a trigger signal applied on the trigger node;

a reset module, for resetting the trigger signal based on the reset signal;

a latch module, electrically connected between the output module and input module, to hold and pull down the electric potential of the trigger signal; and an input module, electrically connected to the latch module for receiving the scan signal outputted by the previous stage GOA circuit unit, comprising:

a first complementary metal-oxide-semiconductor (CMOS) transmission gate, comprising a second transistor and a third transistor, with the second transistor being a P-channel MOSFET (PMOS) transistor and the third transistor being an N-channel MOSFET (NMOS) transistor; and a first transistor, comprising a drain electrically connected to an output terminal of the first CMOS transmission gate, a gate electrically connected to a gate of the second transistor and a scan signal outputted by the previous stage GOA circuit unit, and a source electrically connected to a first constant voltage, wherein the second transistor comprises a gate electrically connected to the scan signal outputted by the previous stage GOA circuit unit, a source electrically connected to the source of the third transistor, and a drain electrically connected to the drain of the third transistor; the gate of the third transistor electrically connected to the inverted scan signal outputted by the previous stage GOA circuit unit, wherein the reset module comprises:

a fourth transistor, comprising a drain electrically connected to the trigger node, a gate electrically connected to the reset signal, and a source electrically connected to the first constant voltage; and a fifth transistor, comprising a drain electrically connected to a second constant voltage, a gate electrically connected to the reset signal, and a source electrically connected to the latch module.

9. The GOA substrate of claim 8, wherein the input module further comprises a first inverter, comprising an input terminal electrically connected to the gate of the second transistor, and an output terminal electrically connected to the gate of the third transistor.

10. The liquid crystal display of claim 8, wherein the output module comprises:

an NAND gate, comprising an input electrically connected to a second clock signal and the trigger signal;

a second inverter, comprising an input electrically connected to the output of the NAND gate;

a third inverter, comprising an input electrically connected to the output of the second inverter; and a fourth inverter, comprising an input electrically connected to the output of the third inverter to output the scan signal.

11. The liquid crystal display of claim 10, wherein the first clock signal and second clock signal are inverted signals to each other.

12. The liquid crystal display of claim 8, wherein the latch module comprises:

a sixth transistor, comprising a gate electrically connected to a first node, and a source electrically connected to the first constant voltage;

a seventh transistor, comprising a drain electrically connected to the trigger node, a gate electrically connected to a second node and a source electrically connected to the drain of the sixth transistor;

an eighth transistor, comprising a drain electrically connected to the drain of the fifth transistor, a gate electrically connected to a first node, and a source electrically connected to the trigger node;

a ninth transistor, comprising a drain electrically connected to the drain of the fifth transistor, a gate electrically connected to the second node, and a source electrically connected to the trigger node;

a second CMOS transmission gate, comprising an input electrically connected to the first clock signal, and an output electrically connected to the first node to generate voltage to the first node based on the trigger signal of the trigger node; and a tenth transistor, comprising a drain electrically connected to the second constant voltage, a gate electrically connected to the trigger node, and a source electrically connected to the first node.

13. The liquid crystal display of claim 12, wherein the second CMOS transmission gate comprises an eleventh transistor and a twelfth transistor; the latch circuit further comprises a fifth inverter, comprising an input electrically connected to the gate of the twelfth transistor, and an output electrically connected to the gate of the eleventh transistor.

* * * * *